US006726075B1

(12) United States Patent
Patel et al.

(10) Patent No.: US 6,726,075 B1
(45) Date of Patent: Apr. 27, 2004

(54) MODULAR TOOL AND MATERIALS CARRYING APPARATUS

(76) Inventors: Rajiv P. Patel, 1374 Lillian Ave., Sunnyvale, CA (US) 94087; Richard S. Camp, 221 Vista Del Mar, San Rafael, CA (US) 94901

( * ) Notice: Subject to any disclaimer, the term of this patent is extended or adjusted under 35 U.S.C. 154(b) by 0 days.

(21) Appl. No.: 09/894,171

(22) Filed: Jun. 27, 2001

(51) Int. Cl.[7] ..... A45C 15/00

(52) U.S. Cl. ..... 224/582; 224/583; 224/665; 224/684; 224/904

(58) Field of Search ..... 224/582, 583, 224/663, 665, 666, 682, 684, 269, 901.8, 904

(56) References Cited

U.S. PATENT DOCUMENTS 4,408,706 A * 10/1983 Hurley ..... 224/192
4,747,527 A * 5/1988 Trumpower, II ..... 2/311
5,240,156 A * 8/1993 Sicotte et al. ..... 224/148.5
5,497,923 A * 3/1996 Pearson et al. ..... 2/300
5,501,379 A * 3/1996 Munoz ..... 224/240
5,505,356 A * 4/1996 Noriega et al. ..... 2/338
5,604,958 A * 2/1997 Anscher ..... 224/197
5,628,443 A * 5/1997 Deutsch ..... 150/113
5,729,869 A * 3/1998 Anscher ..... 224/272
5,833,095 A * 11/1998 Russell et al. ..... 206/373
5,988,315 A * 11/1999 Crane ..... 182/3
6,213,365 B1 * 4/2001 Stocke et al. ..... 224/223
6,216,931 B1 * 4/2001 Trawinski ..... 224/255

* cited by examiner

*Primary Examiner*—Stephen K. Cronin
(74) *Attorney, Agent, or Firm*—Rajiv P. Patel

(57) ABSTRACT

A modular carrying apparatus includes a base unit and an accessory unit. The base unit includes a first portion (or part) of a fastener and the accessory unit includes a second portion of the fastener. The base unit may removably couple with an object, while the accessory unit is configured to hold materials, for example, building materials, cooking materials, seamstress materials, art materials, and the like. The fastener, having the first portion coupled with the base unit and the second portion coupled with the accessory unit, releasably couple with each other.

11 Claims, 9 Drawing Sheets

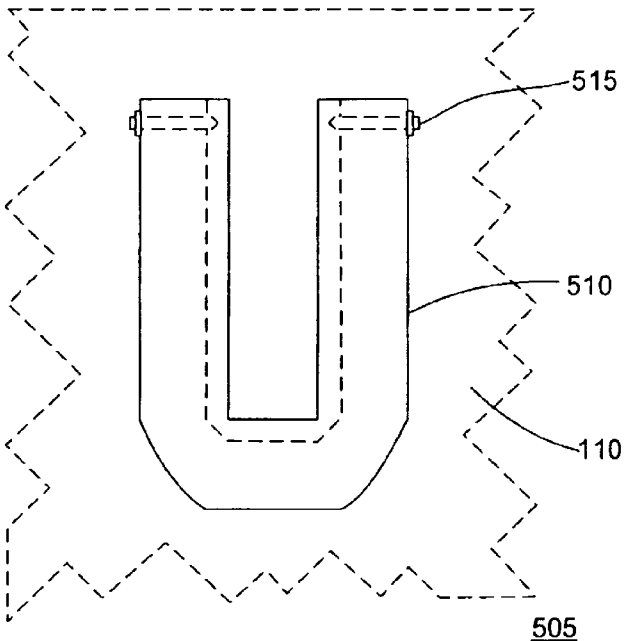
FIG. 5a (1)
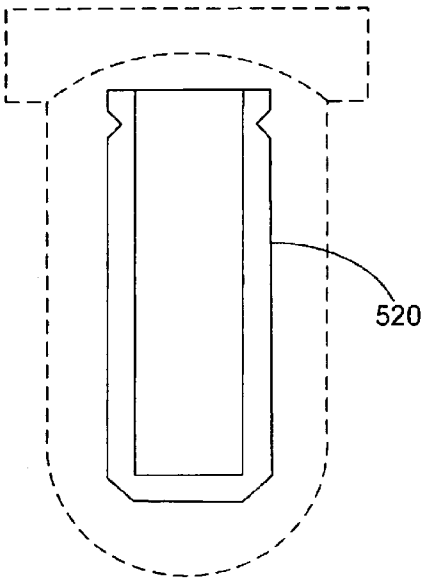
FIG. 5b (1)
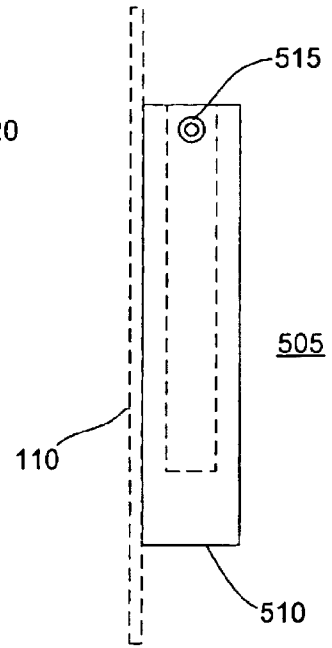
FIG. 5a (3)
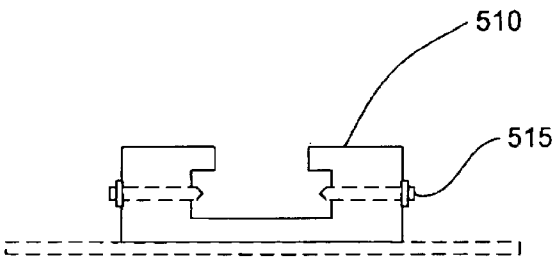
FIG. 5a (2)
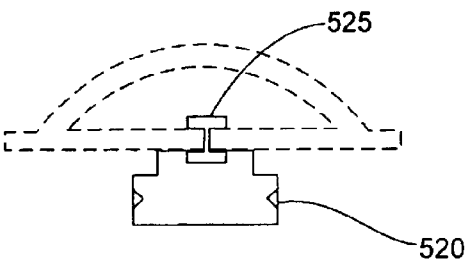
FIG. 5b (2)

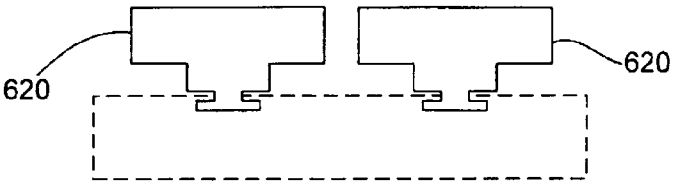
FIG. 6b (1)
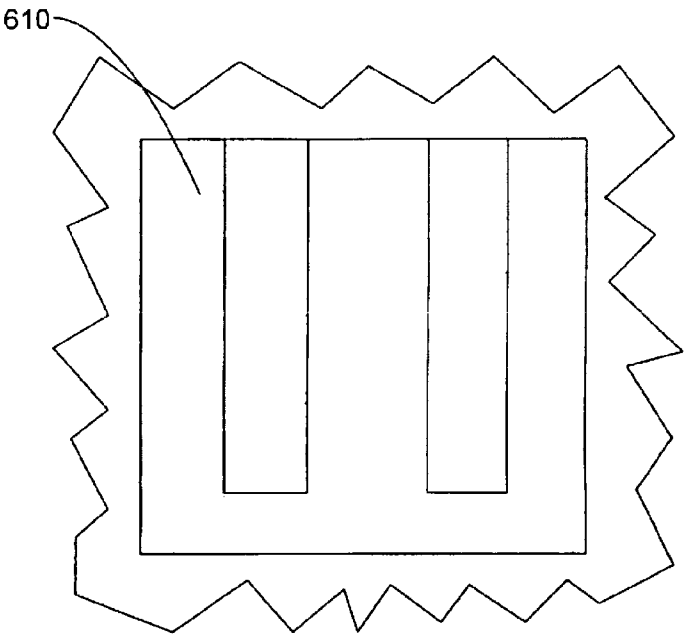
FIG. 6a (3)
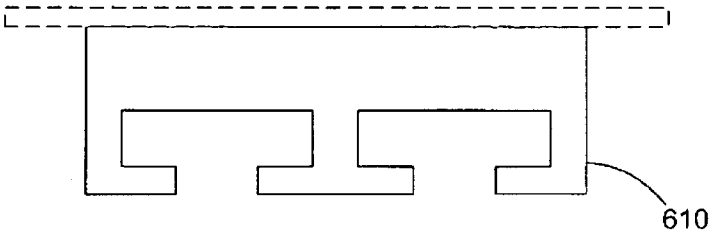
FIG. 6a (1)
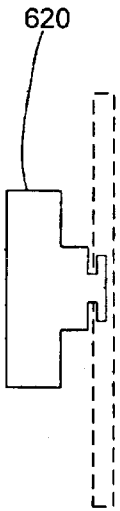
FIG. 6b (2)
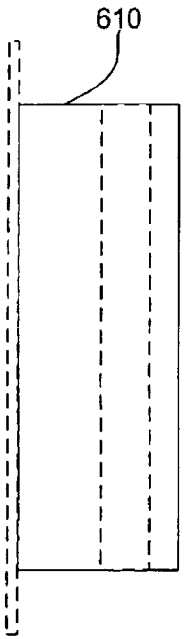
FIG. 6a (2)

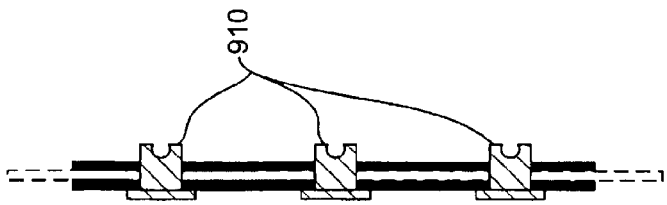
FIG. 9a (3)
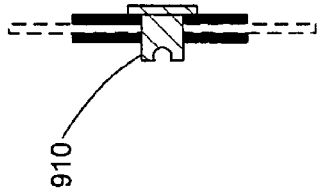
FIG. 9a (2)
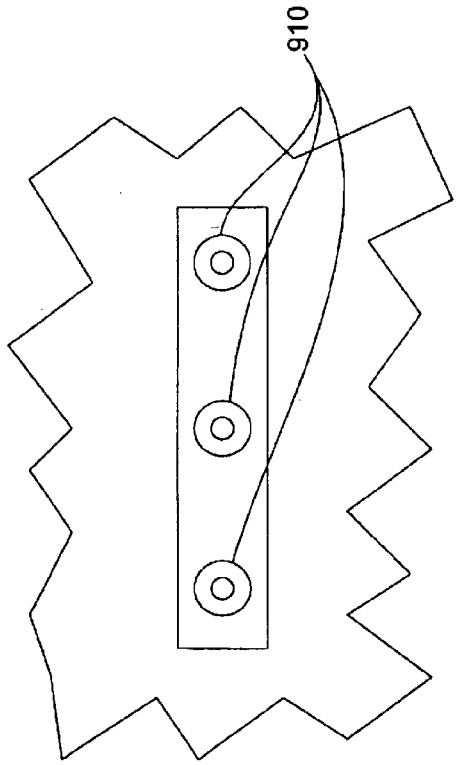
FIG. 9a (1)
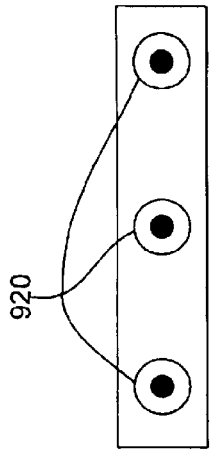
FIG. 9b (3)
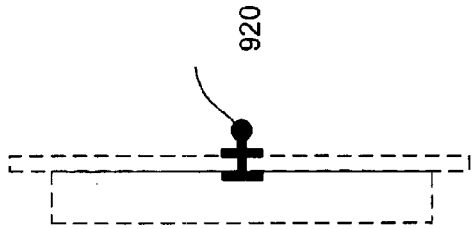
FIG. 9b (2)
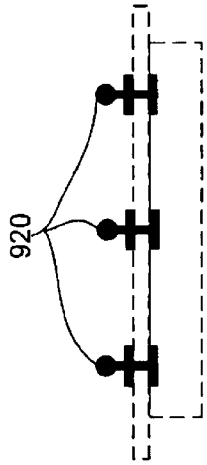
FIG. 9b (1)

MODULAR TOOL AND MATERIALS CARRYING APPARATUS

BACKGROUND OF THE INVENTION

1. Field of the Invention

The present invention relates to devices for holding tools, and more particularly, for an apparatus to carry tools and materials.

2. Brief Description of the Related Art

Tool carrying apparatus are known. A worker in an industry such as a building-type industry, for example, a construction, an electrical, a plumbing, or a hobby-type industry, typically carries a conventional tool belt (or apron). These tool belts are typically worn across a worker's waist (or across the body as with an apron). The conventional tool belt allows the worker to hold and carry tools. These tools include, for example, hammers, wrenches, pliers, screwdrivers, flashlights, tape measures, levels, or the like. Moreover, the conventional tool belt also includes pouches to hold and carry materials also. The materials include, for example, nails, screws, clips, nuts, bolts, caps, or the like.

Other fields in which tool belts or aprons are used include the culinary fields, gardening fields, and tailor and seamstress fields. For example, in the culinary field workers will use a conventional tool belt that has pockets for conventional cooking utensils and materials such as spoons, ladles, cutters, towels, spices, and the like. In the gardening field, workers will use a conventional tool belt for conventional gardening tools and materials, such as mini shovels, mini hoes, plant food, seeds, and the like. Similarly, in the tailor and seamstress field workers will use a conventional tool belt to carry tools and materials such as scissors, tape measures, pins, and the like.

The conventional tool belt, or apron, gives the worker the benefit of having ready access to the tools and materials the worker uses most often. The conventional tool belt also frees the worker from having to carry around bulky toolboxes or buckets to each part of the project.

However, the conventional tool belt (including aprons and the like) have a number of drawbacks. For example, the conventional tool belt has a fixed configuration with respect to its storage areas and tool holders. This fixed design deprives users of the conventional tool belt form having flexibility to interchange components to more closely match the task at hand. For example, in a construction environment, when switching from a framing project to a finishing project a user of a conventional tool belt must completely empty his or her tool belt of framing fasteners and tools and re-load the conventional tool belt with finishing fasteners and tools. This wastes time and money.

Another drawback of the conventional tool belt is that the fixed configuration may be suitable for some user, but may not be suitable for many other users. For example, many conventional tool pouches have a fixed location of pouches and tool holders that are well suited for right-handed users. However, these conventional tool belt configurations are awkward for left-handed users. Moreover, the fixed locations of pouches and tool holders on the conventional tool belt prevent users from individualizing their tool belt in configurations to allow them to achieve their maximum productivity.

Yet another drawback of the conventional tool belt is that the pouches and loops are open-mouthed (or open-ended). While the open-mouthed pouch or loop provides quick access to tools and material, often it results in increasing costs due to excessive waste. For example, materials often fall out of open-mouthed pouches when the conventional tool belt is stored or when a user is working on tasks that do not require the contents of the particular open-mouthed pouch.

Therefore, there is a need for a modular tool pouch and tool carrying apparatus that provides ease or re-configurability, that allows for ease of storage and organization, and that allows for use in a variety of industries.

SUMMARY OF THE INVENTION

One embodiment of a modular carrying apparatus includes abase unit and an accessory unit. The base unit includes a first portion (or part) of a fastener and the accessory unit includes a second portion of the fastener. The base unit may removably couple with an object, while the accessory unit is configured to hold materials, for example, building materials, cooking materials, seamstress materials, art materials, and the like. The fastener, having the first portion coupled with the base unit and the second portion coupled with the accessory unit, releasably (or removably) couple with each other.

In an alternative embodiment of the modular tool carrying apparatus, the base unit includes a central work area (or attachment area). The central work area includes a plurality of zones, with each zone having a first portion of a fastener. In addition, in an alternative embodiment of the modular tool carrying apparatus, there may be a plurality of accessory units. Each accessory unit may include a second portion of a fastener. The second portion of the fastener removably couples the first portion of the fastener in a zone on the central work area. These alternative embodiments illustrate examples of advantages and benefits of the present invention, including configuring the modular tool carrying apparatus in a wide variety of practical configurations for a user.

It is noted that in one embodiment, the accessory units may include a wide variety of pouches and loops that are further configured in a wide variety of sizes and shapes. For example, the accessory unit may be a closable pouch, a tool holster, a tool loop, or a tool basket. Each of the accessory units may be configured to provide securing mechanisms so that materials and tools that are enclosed or attached to each remain secured within or with the particular accessory unit.

The modular tool carrying system advantageously may be assembled in a multitude of different configurations simply by attaching and reattaching, for example, various accessory units with attachment area. In addition, the modular tool carrying system provides additional organization benefits. For example, multiple tool pouches may be organized, labeled, and sealed to meet a variety of different tasks such that each new task does not require removing the contents of a pouch. Rather, each tool pouch is simply attached to or removed from the attachment area of the modular tool carrying system as work is started or completed.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The Figures depict embodiments of objects and features of the present invention(s) and are for illustration purposes only. The Figures are more fully disclosed in the following detailed description, reference being had to the accompanying drawings, in which:

FIGS. 2*a* through 2*f* illustrate various views for a closable pouch for coupling with a modular tool carrying system in accordance with one embodiment of the present invention.

FIGS. 5*a*(1) through 5*b*(2) illustrate various views of a push-pin guide and rail fastener for a modular tool carrying system in accordance with one embodiment of the present invention.

FIGS. 6*a*(1) through 6*b*(2) illustrate various views of a sliding guide and rail fastener for a modular tool carrying system in accordance with one embodiment of the present invention.

FIGS. 9*a*(1) through 9*b*(3) illustrate various views of a snap button connector for a modular tool carrying system in accordance with one embodiment of the present invention.

DETAILED DESCRIPTION OF THE INVENTION

Figure 1A:
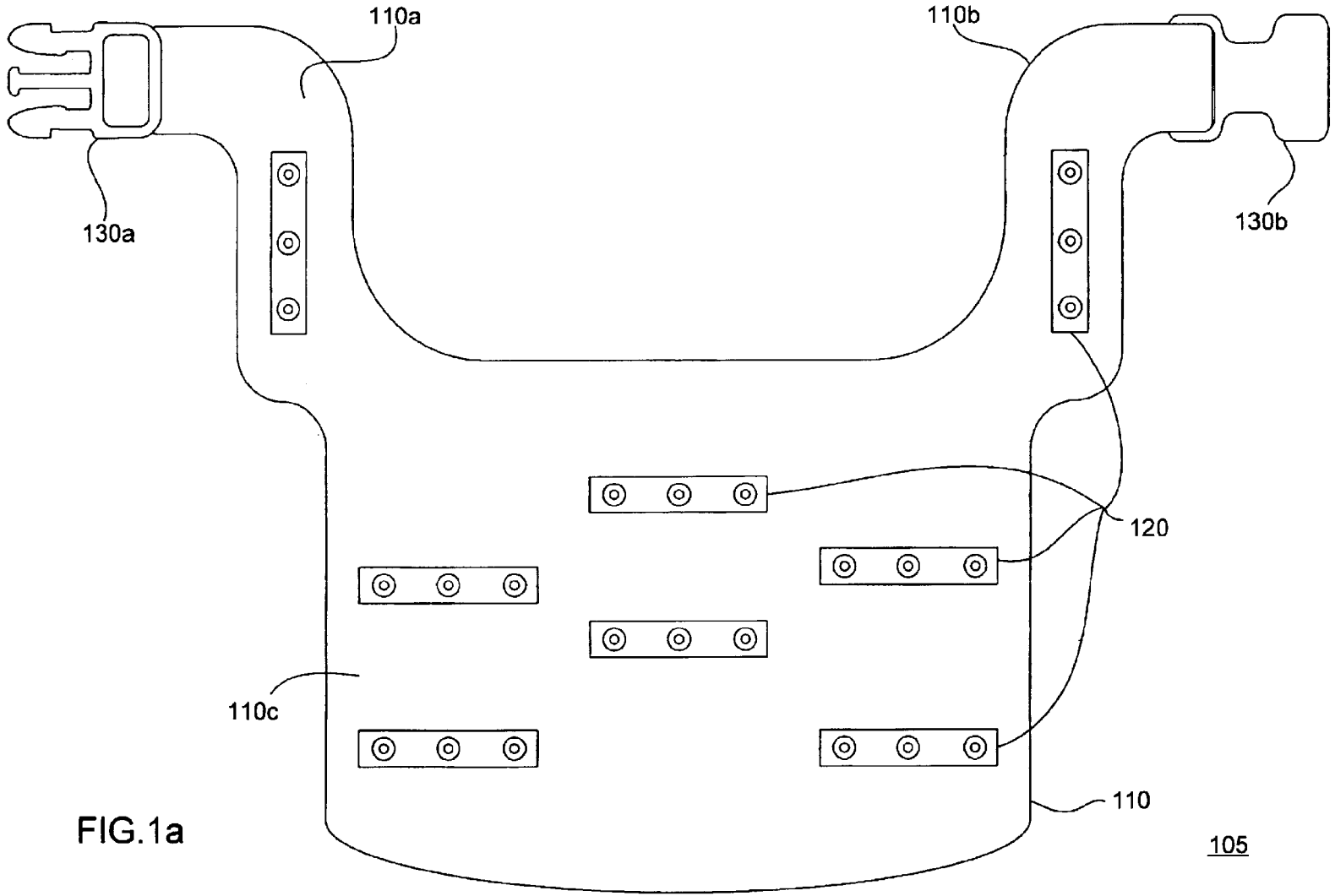
FIG. 1 illustrates a mat for a modular tool carrying system in accordance with one embodiment of the present invention.

FIG. 1 illustrates a mat 110 (or base unit) of a modular tool carrying system 105 in accordance with one embodiment of the present invention. The mat 110 includes one or more receiving slots 120 and a belt attachment mechanism that includes a first portion 130*a* and a second portion 130*b*. For ease of understanding, the mat 110 will be described as a belt-like assembly. However, it is understood the principles disclosed herein are equally applicable to other tool carrying mechanisms, for example, aprons, foldable tool kits, and utility sleeves (e.g., tool sleeves that wrap around a 5-gallon bucket).

The mat 110 may be configured to include a first belt area 110*a*, a second belt area 110*b*, and a main attachment area 110*c*. The mat includes a front and a back. In one embodiment, the one or more receiving slots 120 may be configured to couple with the main attachment area 110*c* along the front of the mat 110. Further, in one embodiment the one or more receiving slots 120 may be grouped together in zones such that a first zone may include, for example, two sets of receiving slots 120 and a second zone may include, for example, one receiving slot 120. In addition, one or more receiving slots 120 may also couple with either or both the first belt area 110*a* and the second belt area 110*b*. The first portion of the belt attachment mechanism 130*a* couples with the first belt area of the mat 110*a*. The second portion of the belt attachment mechanism 130*b* couples with the second belt area of the mat 110*b*.

Generally, the mat 110 is a base unit that serves as a host for the modular tool carrying system 105. In one embodiment the attachment area of the mat 110*c* may be approximately 25 centimeters to 50 centimeters in length by 15 centimeters to 50 centimeters in height. In addition, the first belt area of the mat 110*a* and the second belt area of the mat 110*b* may be sufficiently extended to wrap around an object, for example, a waist of a person. For example, the belt areas 110*a*, 110*b* may add, for example, 50 centimeters to 200 centimeters. Moreover, these belt areas 110*a*, 110*b* may be configured to be adjustable.

Alternatively, the main attachment area of the mat 110*c* may be configured to fit a user's torso, for example, 40 centimeters to 100 centimeters in height by 25 centimeters to 70 centimeters in width, while the first and the second belt areas 110*a*, 110*b* may fit around that user's torso. In yet another embodiment, the mat 110 may be configured as a sleeve having dimensions of, for example, 25 centimeters to 150 centimeters in length and a circumference of 20 centimeters to 150 centimeters to fit in and around a tool carrying apparatus. The tool carrying apparatus may be a tool chest or a bucket, for example, a 5-gallon size paint bucket.

The one or more receiving slots 120 are configured along the main attachment area of the mat 110*c*, and perhaps the first belt area 110*a* and/or the second belt area 110*b* that receive and hold components onto the mat 110. In this manner, the modular tool carrying system 105 provides configuration flexibility to allow a user to configure the modular tool carrying system 105 in a variety of ways by attaching and removing additional components to and from the receiving slots 120.

Further, in one embodiment of the present invention, the receiving slot 120 forms a first part of an attachment assembly (or first part of a fastener) and are configured to receive a second part of the attachment assembly (or second part of the fastener) that is reciprocal to the first part. For example, the receiving slot 120 may be a female portion of a button assembly. Alternatively, the receiving slot 120 may be, for example, a rail or pushpin mechanism. Additional examples of the receiving slot 120 are further described below, for example, in FIGS. 5, 6, and 9. The receiving slots 120 couple with the mat through, for example, rivets, sewn stitches, adhesives, tacks, staples, pins, or any combination thereof.

In one embodiment of the present invention the mat 110 may be constructed of a flexible material, for example, leather, vinyl, nylon, canvas, denim, rubber, or a pliable plastic. The mat 110 may be constructed entirely of the same material, or alternatively, at least a portion of the mat may be constructed of a material that differs from the remainder of the mat 110. In addition, the buckle mechanism 130*a*, 130*b* may be, for example, a conventional belt buckle mechanism (or assembly), a male/female clip mechanism, a loop and clip mechanism, or a string or rope tie mechanism.

Further, in one embodiment of the present invention the buckle mechanism 130*a*, 130*b* may couple with the mat 110 with, for example, an adhesive (e.g., glue, epoxy, or cement), rivets, sewn stitching, tacks, staples, pins, or any combination thereof. The buckle mechanism 130*a*, 130*b* may also couple with the mat 110 such that the first and the second areas of the mat 110*a*, 110*b* loop through the respective buckle mechanism portions 110*a*, 110*b* so that the first and the second areas of the mat 110*a*, 110*b* are adjustable when the buckle mechanism 130*a*, 130*b* are attached.

FIGS. 2 through 8 illustrate various embodiments of accessory units for coupling with the mat 110 (or base unit) in accordance with the present invention. The accessory units include the second part of the attachment assembly (or second part of the fastener) that is reciprocal to the first part of the attachment assembly that may be present on the mat 110. The second part of the fastener may be found on one or more accessory units. FIGS. 2 through 9 illustrate a range of configurations of accessory units for coupling with the mat 110 in accordance with the present invention.

Figures 2A, 2B, 2C, 2D:
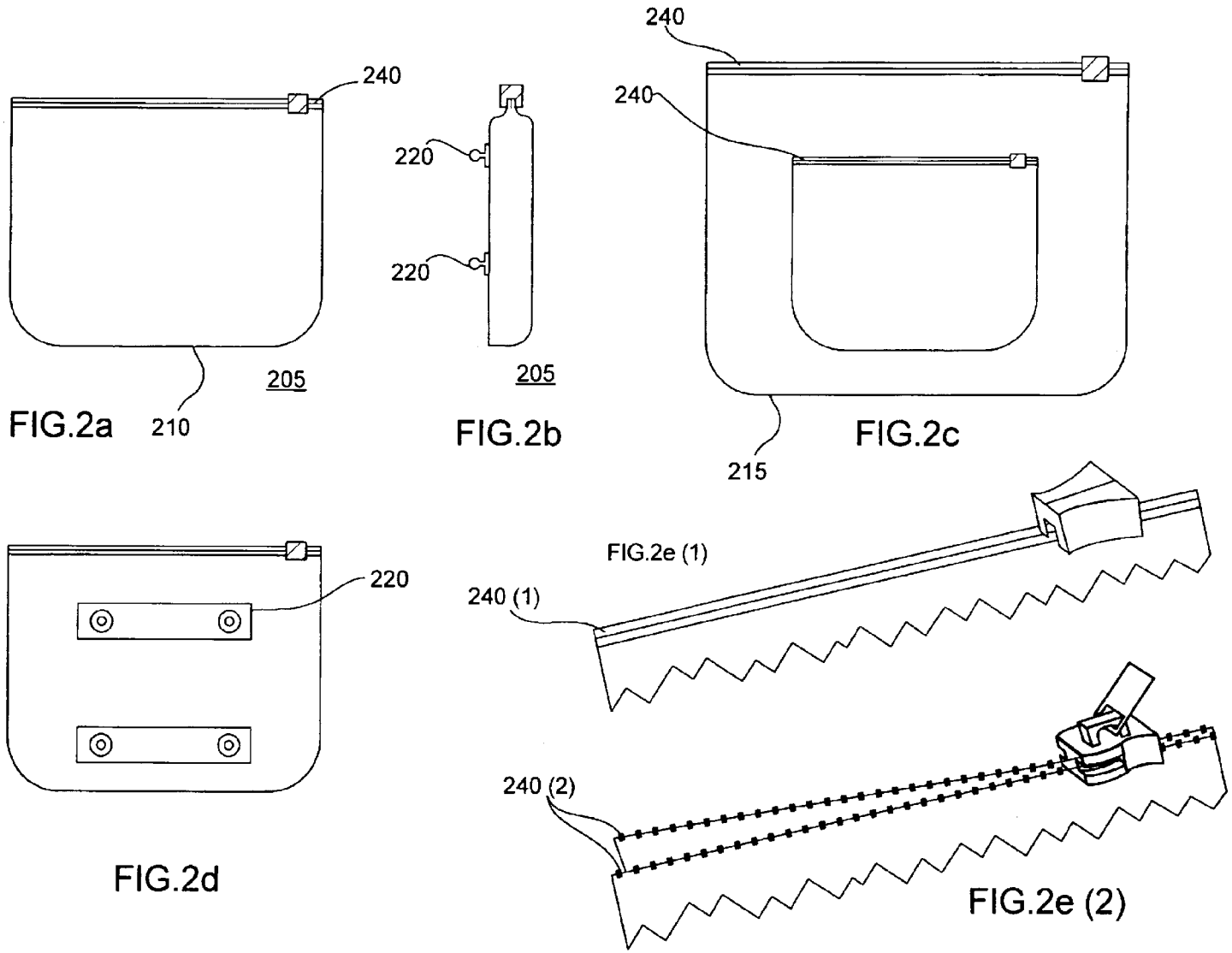

FIGS. 2*a* through 2*f* illustrate various views for a closable pouch 205 for coupling with a modular tool carrying system in accordance with one embodiment of the present invention. FIG. 2*a* illustrates a frontal view of the closable pouch 205. The closable pouch 205 includes a pouch portion 210 and a closure mechanism 240. The pouch portion 210 is fully enclosed with an opening along a substantially top portion where the closure mechanism 240 is located.

The pouch portion 210 may be constructed of a pliable material, for example, a natural material such as leather, cotton, wool, rubber, or the like, or a synthetic material such as polyester, nylon, vinyl, acrylic, a combination thereof, or the like. The closure mechanism 240 may be any mechanism to cover an opening into the pouch portion. For example, the closure mechanism 240 may be a zipper or zip mechanism, a Velcro mechanism, a button mechanism, or a flap mechanism.

FIG. 2*e* illustrates examples of a first embodiment of a zip mechanism 240(1) and a second embodiment of a zip mechanism 240(2) in accordance with the present invention. In the first embodiment of the zip mechanism 240(1), a first side and a second side of a pouch portion 240 opening may be zipped together in a manner functionally similar to a re-sealable storage bag. In the second embodiment of the zip mechanism 240(2) a first side and a second side of the pouch portion 240 opening may be zipped together in a manner functionally similar to a conventional zipper opening.

It is noted, though not illustrated, that a Velcro mechanism may be lined with a Velcro closure spanning substantially an entire length of the pouch portion 240 opening or across one or more smaller area locations along the pouch portion 240 opening. Similar principles apply for the button mechanism or the flap mechanism. The closable pouch 205 may be configured to store a wide variety of small supplies for a wide variety of industries and functions, such as construction, electrical, plumbing, cooking, garment, or the like. For example, the closable pouch 205 may be used to store nails, brads, screws, bolts, couplings, clips, spools, and the like.

FIGS. 2*b* and 2*d* respectively illustrate a side view and a back view of the closable pouch 205 in accordance with one embodiment of the present invention. The side view of the closable pouch 205 illustrates a side view of one or more fastening elements 220. The back view illustrates a configuration of the fastening elements 220 with respect to a back of the closable pouch 205. It is noted that although four fastening elements 220 are illustrated in FIG. 2*d*, the number of fastening elements 220 are not restricted to any particular number. The one or more fastening elements 220 are attached to the back side of the closable pouch 205 with a glue, a rivet assembly, sewing stitches, tacks, staples, pins, or any combination thereof, or the like. The fastening elements 220 are configured to attach to the one or more receiving slots 120 of the mat of the modular tool carrying system 105.

FIG. 2*c* illustrates a second embodiment of a closable pouch 215 in accordance with the present invention. The second embodiment of the closable pouch 215 may include a closable pouch having one or more receiving slots 120 along its front portion. The one or more receiving slots 120 along the front portion of the closable pouch may then be coupled through the fastening elements 220 with the first embodiment of the closable pouch 205 described above. This increases configuration options for the modular tool carrying system 105.

Figure 3A:
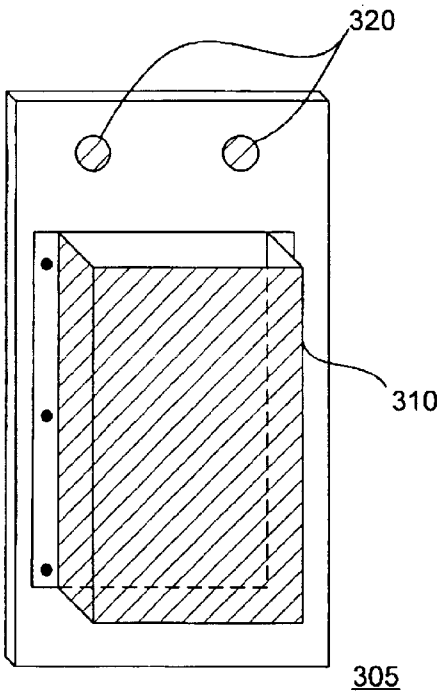
FIGS. 3*a* through 3*c* illustrate various views for an open mouth pouch for coupling with a modular tool carrying system in accordance with one embodiment of the present invention.
Figure 3B:
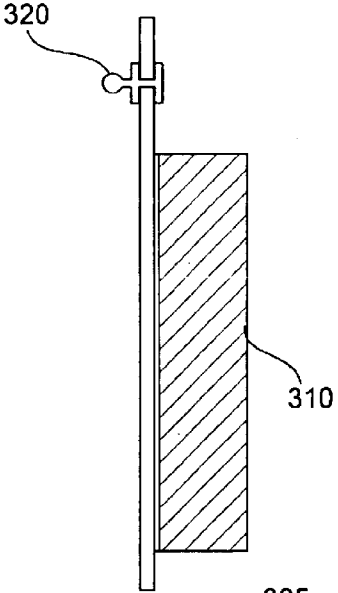
Figure 3C:
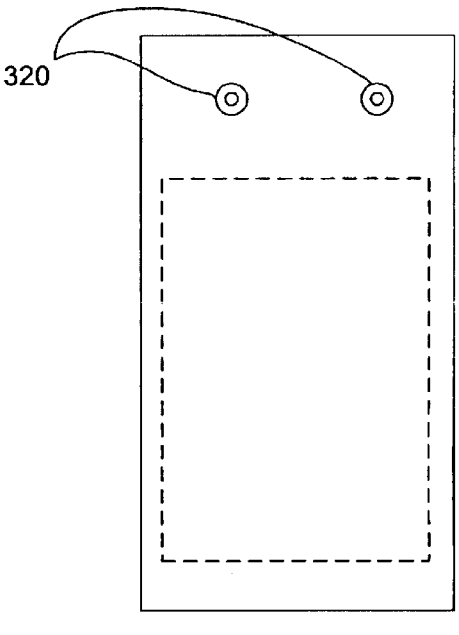

FIGS. 3*a* through 3*c* illustrate various views for an open mouth pouch 305 for coupling with a modular tool carrying system 105 in accordance with one embodiment of the present invention. FIG. 3*a* illustrates a front view of the open mouth pouch 305. The open mouth pouch 305 includes a rigid pouch 310. The rigid pouch 310 may be constructed of a substantially rigid material, for example, a polymer such as plastic, a metal such as flexible aluminum, a hardened rubber, a stiff leather, a combination thereof, or the like. The rigid pouch 310 is open along a top end, closed along the sides, and optionally closed along a bottom end. The rigid pouch may be configured to hold tools, for example, a T-square, a level, a pair of shears or scissors, a nail claw, or the like.

FIGS. 3*b* and 3*c* illustrate a side view and a back view, respectively, of the open mouth pouch. The side view and the back view include illustrations of a second embodiment of a fastening element 320. The second embodiment of the fastening element 320 is functionally equivalent to the first embodiment of the fastening element 220 described above. One or more of the second embodiment of the fastening elements 320 is configured to attach to the receiving slots 120 that may be on, for example, the mat 105, the closable pouch 205, or another open mouth pouch 305 that may have receiving slots 120 along its front or sides.

Figure 4A:
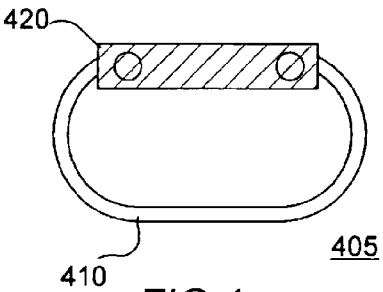
FIGS. 4*a* through 4*c* illustrate various views of a tool loop for coupling with a modular tool carrying system in accordance with one embodiment of the present invention.
Figure 4B:
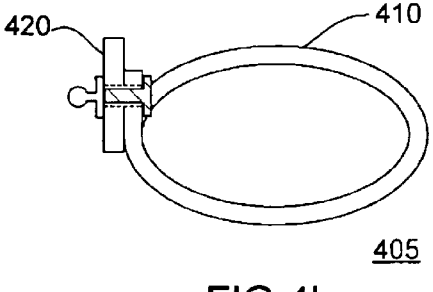
Figure 4C:
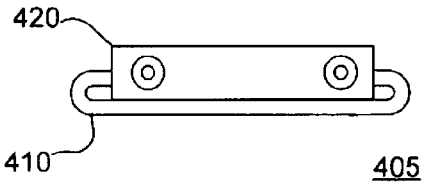

FIGS. 4*a* through 4*c* illustrate various views of a tool loop (tool holder) 405 for coupling with a modular tool carrying system 105 in accordance with one embodiment of the present invention. The tool loop 405 includes a loop 410 and a fastening area. The loop 410 is a substantially rigid member. The loop 410 may be constructed of metal, polymer (including, for example, plastic or vinyl), hardened rubber, leather, or a combination thereof, or the like. The loop is configured to hold a variety of tools, for example, a hammer, a drill, a pair of sheers or scissors, tongs, nail claw, T-square, a level, a right angle, or the like.

The fastening area includes a fourth embodiment of one or more fastening elements 420. The number of fastening elements 420 may vary depending on need. For example, one fastening element 420 allows the tool loop 405 flexibility to pivot while two or more fastening elements 420 provide a more fixed configuration. The fourth embodiment of the one or more fastening elements 420 are functionally equivalent to the first embodiment of the fastening elements 220 described above. In addition, the fourth embodiment of the fastening element couple with the receiving slots of the mat 110 of the modular tool carrying system 105.

FIGS. 5*a*(1) through 5*b*(2) illustrate various views of a push-pin guide and rail fastener for a second embodiment of a modular tool carrying system 105 in accordance with one embodiment of the present invention. FIGS. 5*a*(1) through 5*a*(3) illustrate a second embodiment of a receiving element 505 in accordance with the present invention. FIG. 5*a*(1) illustrates the second embodiment of the receiving element 505 as including a sliding rail (or rail or guide) 510 and an optional locking clip 515. The rail 510 may be configured in a U-shape pattern, although other patterns are possible, such as two parallel rails and a V-shape. The second embodiment of the receiving element 505 couples with the mat 110, for example, by rivets, screws, glue, or other fastening mechanisms. FIG. 5*a*(3) illustrates a side view of the second embodiment of the receiving element 505.

FIG. 5*a*(2) illustrates a top view of the second embodiment of the receiving element 505. In one embodiment, the rail 510 outlines a T-shape opening for receiving a fastening element. FIGS. 5*b*(1) and 5*b*(2) illustrate an embodiment of a fastening element 520 in accordance with the present invention. The fastening element 520 is configured to attach to any embodiment of a pouch or loop, for example the pouches or loops described above, through a fastening mechanism 525, for example, rivets, screws, adhesive, staples, tacks, pins, or a combination thereof.

In one embodiment the fastening element 520 is in a T-configuration and may include optional locking slots. The T-configuration allows the fastening element 520 to slide into the T-shaped opening of the receiving element 505. In some embodiments the optional locking slots of the fastening element 520 couple with the optional locking clips 515 of the receiving element 505 when the fastening element 520 is releasably (or removably) slid down the rail 510 of the receiving element 505. Coupling the fastening element 520 with the receiving element 505 couples the pouch or loop with the mat of the modular tool carrying apparatus.

FIGS. 6*a*(1) through 6*b*(2) illustrate a third embodiment of a receiving element and fastening element in accordance with one embodiment of the present invention. For example, the third embodiment of the receiving element 605 includes a two slot sliding rail (rail or guide) 610 that couples with the mat 110. In addition, the third embodiment of the fastening element includes two rail fasteners 620 that couples with, for example, a pouch or loop. The two rail fasteners 620 couple the receiving element 605 by slidably coupling the rail 610. In some embodiments the additional rail may provide additional strength, rigidity, and stability to, for example, a pouch or loop attachment to the mat 110 of the modular tool carrying system.

It is noted that the embodiments of the receiving elements and fastening elements illustrated in FIGS. 5 and 6 may be constructed from a variety of substantially rigid materials, for example, rigid plastics, polymers, leathers, metals or some combination thereof.

Figure 7B:
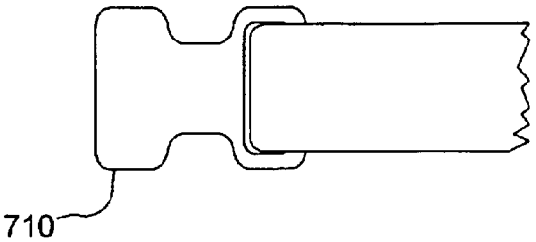
FIGS. 7*a* and 7*b* illustrate a clip assembly for a modular tool carrying system in accordance with one embodiment of the present invention.
Figure 7A:
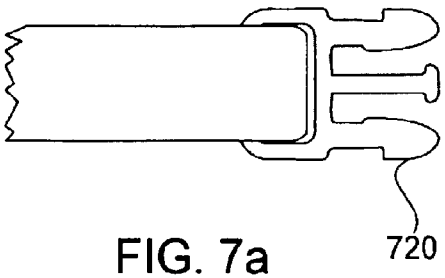

FIGS. 7*a* and 7*b* illustrate a clip assembly for the modular tool carrying system 105 in accordance with one embodiment of the present invention. The clip assembly may be used for the mat 110 to tie the modular tool carrying system 105 around an object (including a person). The clip assembly may also be configured so that a female end 710 is, for example, a receiving element on the mat 110 and the male end 720 is a fastening element on, for example, a pouch or a loop. When the male and the female portions couple together, for example, clip or snap together, the pouch, e.g., 205, or the loop, e.g., 405, couple with the mat 110.

Figure 8C:
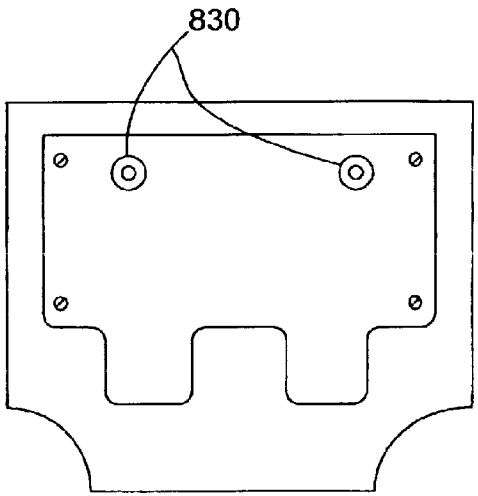
FIGS. 8*a* through 8*c* illustrate a rigid tool holster for coupling with a modular tool carrying system in accordance with one embodiment of the present invention.
Figure 8B:
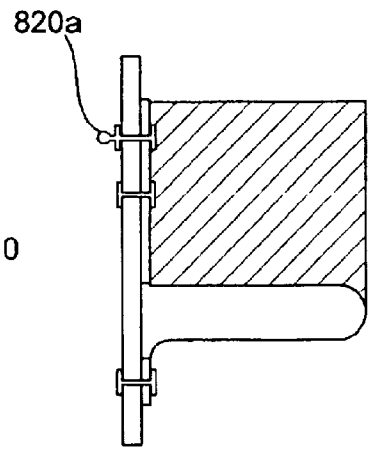
Figure 8A:
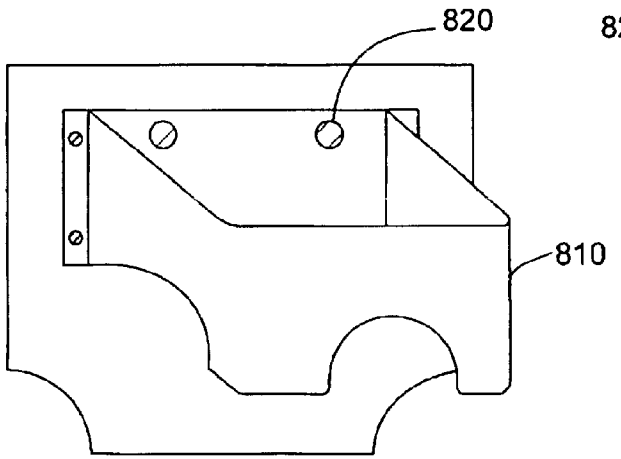

FIGS. 8*a* through 8*c* illustrates a rigid tool holster 805 for coupling with the mat 110 of the modular tool carrying system 105 in accordance with one embodiment of the present invention. The rigid tool holster 805 includes a deep loop 810 that includes one or more fastening elements 820, 820*a*, for example, a male fastening member. The deep loop 810 may be constructed from a rigid material, for example, a plastic, a polymer, leather, a metal, or a combination thereof. The rigid tool holster 805 may be configured to hold heavier or more clumsy tools, for example, a drill, a solder gun, tongs, or the like. In one embodiment, the mat 110 includes one or more receiving elements 830, for example, a female fastening member, that receives the one or more male fastening element 820, so that the rigid tool holster 805 couples with the mat 110 of the modular tool carrying system 105.

FIGS. 9*a*(1) through 9*b*(3) illustrate various views of an example fastening system for a modular tool carrying system in accordance with one embodiment of the present invention. The example fastening system includes a snap button connector having a female receiving end 910 and a male fastening end 920 that are configured to releasably snap or attach together. The fastening system may be constructed of a rigid material, for example, a polymer (including, for example, a plastic or vinyl), metal, rubber, or a combination thereof.

Figure 10:
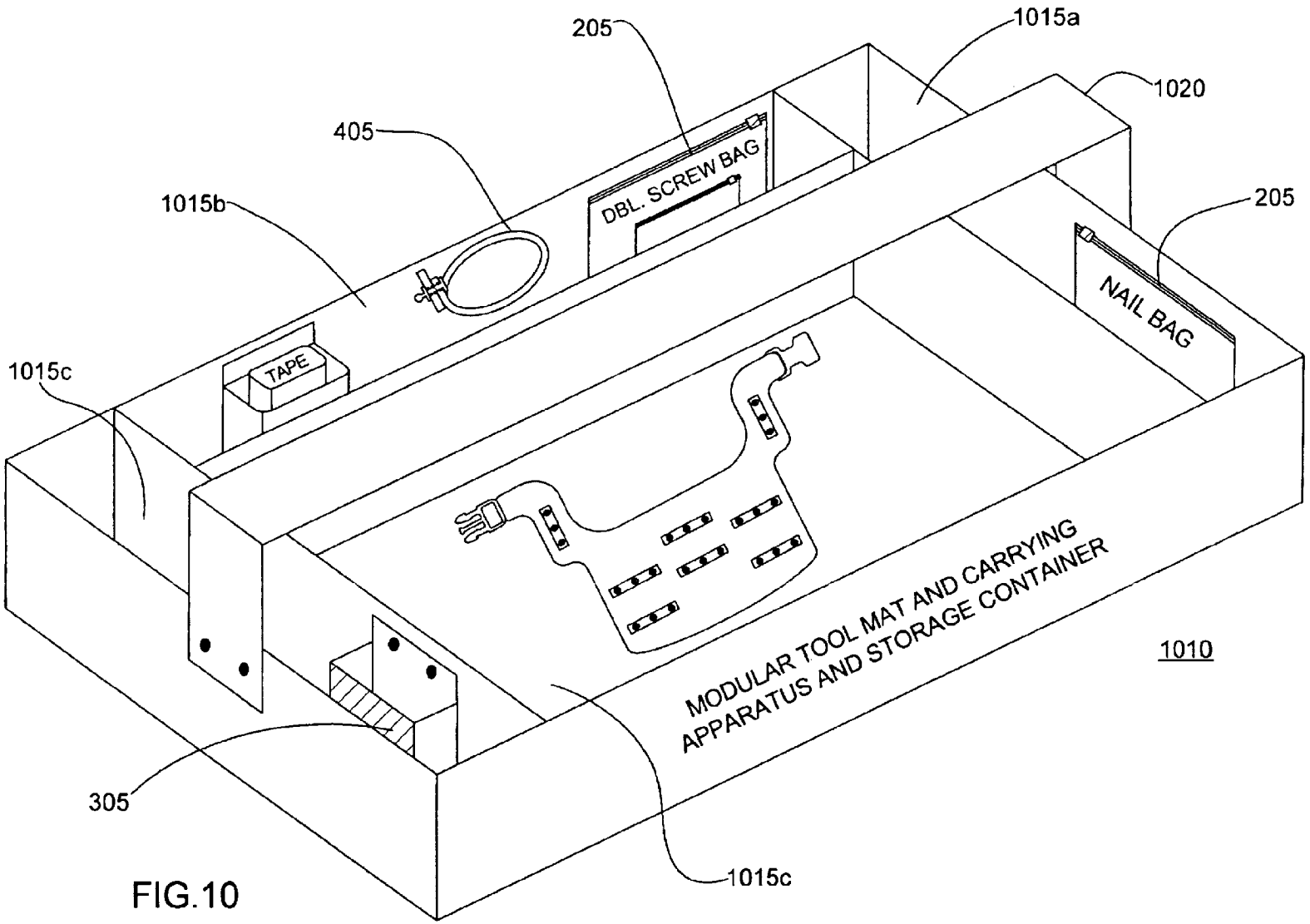
FIG. 10 illustrates a modular tool carrying system storage case in accordance with one embodiment of the present invention.

Turning briefly to FIG. 10, there is illustrated a modular tool carrying system storage case 1010 in accordance with one embodiment of the present invention. The storage case 1010 includes one or more compartments, e.g., 1015*a*–1015*c*. In addition, the storage case 1010 may include a handle 1020 for carrying convenience to a user. The handle 1020 may be a uni-body construction with the remainder of the storage case 1010 or may be attached to the storage case 1010 by rivets, pins, stables, tacks, adhesive, sewn stitching, ball bearing assembly, or a combination thereof.

In one embodiment, the one or more compartments, e.g., 1015*a*–1015*c*, may be configured to hold the base unit 105 in one compartment, e.g., 1015*c*, and pouches 205, 305 and tool loops 405 in other compartments, e.g., 1015*a*, 1015*b*.

In one embodiment, the storage case 1010 may be constructed of a rigid material, for example, a polymer (including, for example, a plastic or vinyl), nylon, metal, rubber, or any combination thereof. In an alternative embodiment the storage case 1010 may be constructed from a pliable material, for example, pliable polymer (for example, a pliable plastic or vinyl), heavy-duty nylon, a canvas cloth, leather, or any combination thereof. In yet another embodiment the storage case 1010 may be constructed from a combination of rigid and pliable materials.

A benefit of storage case 1010 is that it provides an organization mechanism for storage of the modular tool carrying apparatus, including its base unit and its one or more accessory units. This allows a user of the modular tool carrying apparatus to keep their tools and materials well organized and easily accessible, which allows for increased worker productivity.

Figure 11:
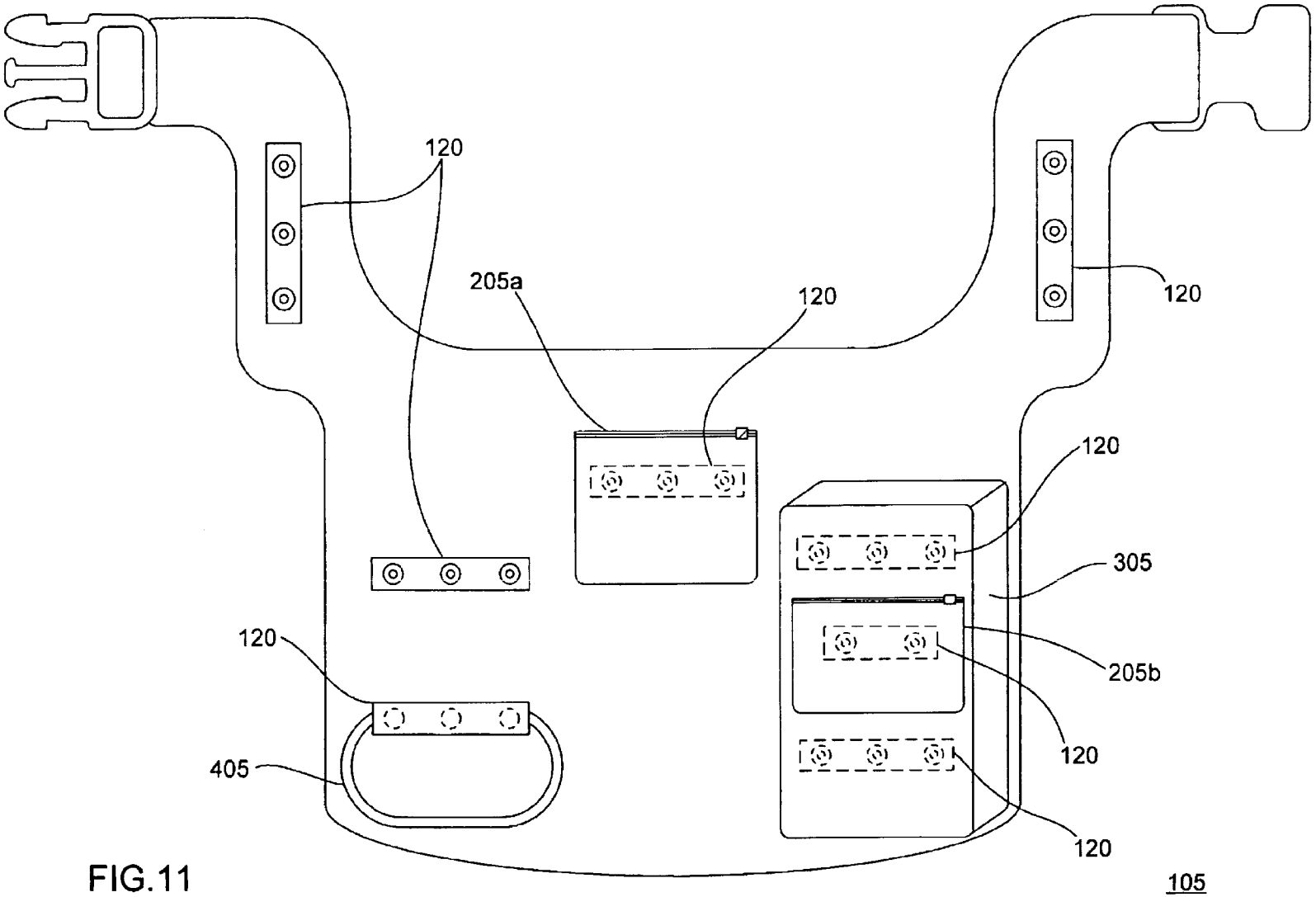
FIG. 11 illustrates a modular tool carrying system having a plurality of accessories in accordance with one embodiment of the present invention.

FIG. 11 illustrates a modular tool carrying system having a plurality of accessories in accordance with one embodiment of the present invention. In an example embodiment, a first closable pouch 205 releasably couples with a first zone on the front of the mat 110. The first zone includes one set of receiving slots 120. Similarly, the tool loop 405 releasably couples with a second zone, which includes another set of receiving slots 120. The open mouth pouch 305 releasably couples with a third zone, which includes two sets of receiving slots 120. In addition, a second closable pouch 205 releasably couples with a zone having a set of receiving slots 120 on the front of the open mouth pouch 305.

The description above illustrates a number of benefits and advantages of the present invention. For example, the modular tool carrying system 105 may be assembled in a multitude of different configurations simply by attaching and reattaching various accessory units, for example, pouches and loops, with the mat 110.

In addition, the present invention provides additional organization benefits. For example, accessory units may be organized, labeled, attached, removed, or stored to meet a variety of different tasks. Each new task does not require removing the contents of a fixed, open-mouthed pouch or attaching a new tool belt. Rather, the present invention beneficially allows for removing or adding accessory units to the mat to address the needs for the task at hand.

For example, a construction worker may have one tool pouch for framing nails, one for drywall screws, and a third for finishing nails. As the construction worker progresses on a construction project the worker simply detaches one tool pouch and replaces it with the next tool pouch for the project. Moreover, because each pouch or loop may be locked down or closed, the contents of such pouch or loop are secured or confined. The construction worked does not need to continuously empty and refill fixed, open-mouthed pouches on a tool belt nor does the construction worker worry about loosing the contents of a pouch or loop. Thus, there is a measurable savings in time and money.

Upon reading this disclosure, those of skill in the art will appreciate still additional alternative methods and designs for a modular tool carrying system in accordance with the present invention. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. A modular tool carrying apparatus comprising:

a base unit comprised of a pliable material for fitting about a user, the base unit for coupling with a central work area and having a plurality of zones, each zone having a at least one rail; and a plurality of accessory units, each having a push-pin guide for removably coupling the at least one rail in a zone, the at least one rail and the push pin guide forming a substantially rigid assembly where coupled, and wherein at least one accessory unit comprises a pliable material and including one end having a closable opening to form a pouch.

2. The modular tool carrying apparatus of claim 1, wherein the base unit comprises one from a group comprising leather, vinyl, nylon, canvas, denim, and a pliable plastic.

3. The modular tool carrying apparatus of claim 1, wherein a second accessory unit of the plurality of accessory units comprises one from a group consisting of a tool holster, a tool basket, and a tool loop.

4. The modular tool carrying apparatus of claim 1, wherein the pouch comprises a material of one from a group consisting of a leather, vinyl, nylon, canvas, denim, and a pliable plastic.

5. The modular tool carrying apparatus of claim 4, wherein the pouch is configured for sealing at the closable opening and is configured for removal from the base unit for storage in a storage unit.

6. The modular tool carrying apparatus of claim 1, wherein the at least one rail comprises one from a group consisting of a U-shaped rail, a parallel rail, and a V-shaped rail.

7. The modular tool carrying apparatus of claim 1, wherein the base unit comprises a mat.

8. The modular tool carrying apparatus of claim 7, wherein the mat comprises one from a group consisting of a tool belt, an apron, and a utility sleeve.

9. A modular tool belt comprising:

a base unit comprising a pliable material and having a plurality of rails, the plurality of rails configured on the base unit to form a plurality of zones;

a plurality of first accessory units, each first accessory unit configured to include a push-pin guide for releasably coupling with a rail of the plurality of rails, the push-pin guide and the rail of the plurality of rails forming a substantially rigid coupling when coupled together, at least one accessory unit of the plurality of first accessory units configured to hold a tool; and a plurality of second accessory units, each configured to include the push-pin guide for releasably coupling with a rail of the plurality of rails, and configured to include an enclosure mechanism for configuration as a self containable enclosable pouch.

10. The modular tool belt of claim 9, wherein the plurality of second accessory units comprises a material of one from a group consisting of a leather, a vinyl, a denim, a cloth, a canvas, a pliable plastic, and a nylon.

11. The modular tool belt of claim 9, wherein the enclosure mechanism comprises one from a group consisting of a zipper, a Velcro, and a zip seal assembly.

* * * * *